US005774770A

United States Patent [19]

Hiroshi

[11] Patent Number: 5,774,770

[45] Date of Patent: Jun. 30, 1998

[54] IMAGE FORMING APPARATUS CAPABLE OF PREVENTING A TONER-FILMING PHENOMENON CAUSED ON DEVELOPMENT ROLLER SURFACE IN EFFECTIVE AND ECONOMICAL MANNER

[75] Inventor: Ueno Hiroshi, Atsugi, Japan

[73] Assignee: Ricoh Company, Ltd., Tokyo, Japan

[21] Appl. No.: 786,652

[22] Filed: Jan. 21, 1997

[30] Foreign Application Priority Data

Jan. 18, 1996 [JP] Japan ..... 8-024761
Dec. 20, 1996 [JP] Japan ..... 8-355261

[51] Int. Cl.[6] ..... G03G 15/06

[52] U.S. Cl. ..... 399/222; 399/358; 399/359

[58] Field of Search ..... 399/347, 350, 399/358, 359, 343, 264, 222, 71

[56] References Cited

U.S. PATENT DOCUMENTS

| | | | |
|---|---|---|---|
| 3,678,896 | 7/1972 | Hewitt | 399/359 |
| 3,752,576 | 8/1973 | Gerbasi | 399/359 |
| 4,752,805 | 6/1988 | Fukae et al. | 399/359 |
| 4,962,408 | 10/1990 | Masuda et al. | 335/245 |
| 4,975,748 | 12/1990 | Koinuma et al. | 399/347 |
| 5,128,724 | 7/1992 | Hayashi et al. | 399/119 |
| 5,481,351 | 1/1996 | Kawai et al. | 399/359 |
| 5,493,382 | 2/1996 | Takagaki et al. | 399/359 |
| 5,555,469 | 9/1996 | Ishikawa et al. | 399/258 |
| 5,604,575 | 2/1997 | Takagaki et al. | 399/359 |

FOREIGN PATENT DOCUMENTS 9-006200 1/1997 Japan .

*Primary Examiner*—Matthew S. Smith
*Attorney, Agent, or Firm*—Oblon, Spivak, McClelland, Maier & Neustadt, P.C.

[57] ABSTRACT

Image forming apparatus which prevents occurrence of a toner-filming phenomenon on a development roller thereof by performing a toner freshening operation. When the image forming apparatus performs the toner freshening operation, an amount of the toner remaining unused on the development roller can totally be transferred onto a photoconductive drum at a predetermined timing for a predetermined time period at a predetermined rate of frequency so as to effectively prevent occurrence of the toner-filming phenomenon. The amount of toner used for the toner-freshening operation can be kept clean and returned to the development roller in a form without agglomerating by an unused toner returning mechanism mounted in an image forming unit of the image forming apparatus. The image forming apparatus has a dust free configuration, and may further include an air fan including an electrostatic filter and a front loading type paper cassette.

73 Claims, 6 Drawing Sheets

IMAGE FORMING APPARATUS CAPABLE OF PREVENTING A TONER-FILMING PHENOMENON CAUSED ON DEVELOPMENT ROLLER SURFACE IN EFFECTIVE AND ECONOMICAL MANNER

BACKGROUND OF THE INVENTION

1. Field of the Invention:

This invention relates to an image forming apparatus, and more particularly, such as a copying machine, a laser printer, a laser facsimile machine or the like, which is capable of preventing in an effective and economical manner a toner-filming phenomenon caused around a surface of a development roller at which an amount of long-unused-toner remains.

2. Discussion of the Background:

A background image forming apparatus, such as, a copying machine, a laser printer, a laser facsimile machine, or the like, is generally provided with an image forming procedure having sequential processes from input of image information through to an image recording onto a recording medium. More specifically, such an image forming procedure for a background copying machine, for example, includes the following sequential processes: optically reading an image of an original document; converting read image information into optical information in a form of light such as a laser beam, for example; writing an electrostatic latent image from the image of the original document onto a photoconductive region referred to as a photoconductive drum using the light such as the laser beam, for example; visualizing the latent image with toner stored in a so-called development unit including a toner conveyer for conveying the toner to the photoconductive drum; and transferring the visualized image onto a recording medium, as examples.

Further, the image forming procedure commonly includes a process of cleaning the toner remaining on the surface of the photoconductive drum, which toner may be referred to as unused-toner, into a container for disposal after the above-mentioned transferring process. In addition, as a recent trend, various techniques have been developed in conjunction with a new process in which such unused-toner can be returned to the development unit so as to recycle the unused-toner, contrary to the above-mentioned common process for cleaning the unused-toner into a container for disposal.

However, in a type of the background image forming apparatus, such as a copying machine or the like, in which an electrophotography method is adopted and a single component type toner is applied, there remains an unsolved problem called a toner-filming phenomenon that occurs on the surface of the toner conveyer, generally called a development roller, for conveying toner. When this toner-filming phenomenon occurs on the development roller, a state of an electric charge of the toner on the development roller becomes unstable although the toner is evenly applied with the electric charge in order to be orderly controlled during processes performed afterwards. Accordingly, an image may be formed of a greatly inferior quality on a recording material with such an unstable state of the electric charge of the toner, resulting in an abnormal printing such as undesired dirty toner spots on the surface of the recording material, deterioration in image density, and so forth.

This toner-filming phenomenon occurs particularly in the following condition. If a copying machine is capable of copying an A3 portrait (297 mm in width), for example, and has a development roller of 303 mm, for example, in length, suppose that a number of original documents in an A4 portrait (210 mm in width) are continuously read on this copying machine. In this case, an entire amount of toner carried by the development roller mounted in the development unit of the copying machine is not fully used, but only an amount of toner held on a 210 mm wide part, referred to as an image area, of the surface of the 303 mm long development roller is used. Accordingly, the rest of the toner held on a region beyond the 210 mm wide part, referred to as a non-image area, of the surface of the 303 mm long development roller remains unused during successive image development processes and tends to stick to the same region in the non-image area of the surface of the development roller by means of a Coulomb force caused from the applied electric charge.

For the sake of clarity, the toner remaining on the non-image area of the surface of the development roller is referred to as primary unused-toner and the remaining toner on the surface of the photoconductive drum is referred to as secondary unused-toner.

Generally, the development roller in the development unit of the copying machine is provided with a member or a so-called doctor blade. This doctor blade scrapes an excessive amount of toner off the surface of the development roller so as to regulate the amount of toner to be fed equally along the length of the development roller. The doctor blade has an axis in parallel to the axis of the development roller, and is held in a fixed position relative to a rotating movement of the development roller and in close proximity to a surface of the development roller over its entire length.

The above-mentioned doctor blade for regulating the toner amount also functions as a toner presser, as a matter of fact. More specifically, the doctor blade regulates the amount of toner, including the toner in the image area and the primary unused-toner in the non-image area, on the development roller by scraping off an amount of toner. After one rotation of the development roller, the primary unused-toner remains in the same non-image area covered with an additional amount of toner thereon. Then, the doctor blade presses the primary unused-toner down to the surface of the development roller, while scraping off the additional amount of the toner. The primary unused-toner pressed down to the surface of the development roller accordingly forms a thin film and may pass through a gap made between the surface of the development roller and the doctor blade due to a thinness of the thin film made of the toner. In addition, when the doctor blade applies a pressure to the primary unused-toner, the pressure generates heat that increase adhesion strength of the primary unused-toner onto the surface of the development roller.

After passing through the gap of the doctor blade, the primary unused-toner in a thin film shape may be stuck onto the same region of the non-image area over a period of a number of rotations of the development roller by the applied pressure and heat. With increasing numbers of rotations of the development roller, the primary unused-toner in the thin film shape more firmly adheres onto the same non-image area in the surface of the development roller. Further, with increasing numbers of applications of the pressure by the doctor blade, an amount of electric charge of the primary unused-toner increases. Thus, the primary unused-toner in the thin film shape more firmly adheres onto the same non-image area in the surface of the development roller. In this way, when the background copying machine performs a copying operation with the same image for a relatively large number of times, the toner on the image area in the surface of the development roller can be kept used while the toner on the non-image area in the surface of the development roller may be kept unused and may firmly stick on the surface of the development roller. As a result, the toner-filming phenomenon occurs on the surface of the development roller.

This toner-filming phenomenon may occur not only in the case of the background image forming apparatus such as a copying machine adopting electrostatic photography with the single component type toner but also in a case in which dual-component type toner is used.

To solve the above-mentioned toner filming problem, the official gazette of the Japanese Laid Open Patent Application TOKUKAI HEI 6-289722 (1994) teaches a solution in which the background copying machine is provided with a magnetized bar. This magnetized bar is mounted in contact with a surface of a development roller to ease adhesion of the thin film toner stuck onto the surface of the development roller. The toner may accordingly be removed from the surface of the development roller. However, this solution can not protect an occurrence of the toner-filming phenomenon since it can not sufficiently remove the toner from the surface of the development roller.

It may also be possible to solve the toner-filming problem by using an ordinary image forming operation. More specifically, a copying machine may be arranged to automatically and periodically perform an image forming operation with a black image covering a maximum area of a surface of a photoconductive drum usable as an image area. By this operation, an entire amount of the toner on the surface of a development roller is transferred onto the surface of the photoconductive drum during one cycle of an image forming operation. This operation may be referred to as a toner-freshening operation hereinafter for the sake of clarity.

However, this toner-freshening operation brings other problems in which a relatively large amount of toner is rapidly consumed for the purpose of preventing the toner-filming problem without being actually used to form an image. In addition, such a toner-freshening operation has not been arranged in a way to sufficiently prevent an occurrence of the toner-filming problem for lack of a detailed study on conditions to make this operation effective, such as, a timing and a time period of the toner-freshening operation, a level of a development bias to be applied, and so forth. Based on such a problematic situation, an image forming apparatus such as a copying machine which is provided with a function of the above-mentioned toner-freshening is not yet known to the public.

Also possible is an image forming apparatus such as a copying machine which automatically and periodically performs an image forming operation for preventing an occurrence of the toner-filming problem in an effective and economical manner, on the basis of a detailed study on correct conditions to be made for the toner-freshening operation. Such a system, however, may not be effective and economical.

SUMMARY OF THE INVENTION

Accordingly, an object of the present invention is to provide a novel image forming apparatus which is capable of preventing occurrence of toner-filming in an effective and economical manner.

The above object of the present invention can be achieved by the following novel image forming apparatus which is capable of performing a toner freshening and returning operation in which toner is formed over an area of a toner carrying roller for carrying toner and then, without transferring the toner onto a recording material, the toner is returned to be used in an ordinary image forming operation, and which includes a toner containing tank for containing toner, an image carrying drum for carrying an electrostatic latent image thereon, an image writing unit for writing the electrostatic latent image in at least one of the ordinary image forming operation and the toner freshening and returning operation, a high voltage power applying unit for applying a high voltage power to the toner carrying drum to generate a voltage gap between the toner carrying roller and the image carrying drum to transfer from the toner carrying roller to the image carrying drum, a toner collecting unit for collecting the toner deposited on the image carrying drum, a toner returning unit for returning the toner collected by the toner collecting unit to the toner containing unit, and a toner freshening and returning control unit for performing the freshening and returning operation at a predetermined timing for a predetermined time period.

In the above-mentioned image forming apparatus, the toner freshening and returning control unit controls the high voltage power applying unit to apply a high voltage power to the toner carrying roller for an ordinary image forming operation and a different high voltage power to the toner carrying roller for the toner freshening and returning operation, and the toner freshening and returning control unit switches the high power voltage applying unit between the high power voltage and the different high power voltage.

Further, in the above-mentioned image forming apparatus, the toner freshening and returning control unit controls to make a size of an area over which the toner is formed in the toner freshening and returning operation greater than a size of an area of a toner carrying surface of the toner carrying roller during a time of performing the toner freshening and returning operation.

Further, the above-mentioned image forming apparatus includes a toner mixing unit for receiving, for temporarily storing, and for mixing the toner returned through the toner returning unit before returning the toner into the toner containing tank.

In the above-mentioned toner mixing unit, its operation is started, by the toner freshening and returning control unit, to mix the toner at a same time when the high voltage power applying unit starts to apply the different high voltage power to the toner carrying roller and to continue to mix the toner for a predetermined time period after the high voltage power applying unit finishes applying the different high power voltage power to the toner carrying roller.

Still further, in the above-mentioned image forming apparatus, the toner freshening and returning control unit controls to perform the toner freshening and returning operation during a time period of an event when an image carrying region of the image carrying unit carries no image and the image carrying region passes through the toner carrying roller during a continuous operation of the ordinary image forming operation.

In the above-mentioned toner freshening and returning control unit, the toner freshening and returning operation is controlled to lengthen the time period of an event when an image carrying region of the image carrying drum carries no image and the image carrying region passes through the toner carrying roller during a continuous operation of the ordinary image forming operation, to an extent relatively longer than a time necessary for the toner carrying roller to carry the toner by a single time, so as to make a size of an area over which the toner is formed in the toner freshening and returning operation greater than a size of an area of the toner carrying surface of the toner carrying roller during a time of performing the toner freshening and returning operation.

Still further, in the above-mentioned image forming apparatus, the toner freshening and returning control unit controls to perform the toner freshening and returning operation out of synchronism with a movement of the toner carrying roller so that an entire toner carrying surface of the toner carrying roller can be subjected to the toner freshening and returning operation.

Still further, in the above-mentioned image forming apparatus, the recording material is stored in a recording material cassette by which the recording material is kept away from dust so as to effectively perform the toner freshening and returning operation.

Yet further, in the above-mentioned image forming apparatus, the image forming apparatus includes a heat air ejecting fan which includes an electrostatic filter for collecting dust so as to effectively perform the toner freshening and returning operation.

Other objects, features, and advantages of the present invention will become apparent from the following detailed description when read in conjunction with the accompanying drawings.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein:

FIG. 8(*b*) is a partly sectional view of an air outlet portion of the novel copying machine shown in FIG. 8(*a*).

DESCRIPTION OF THE PREFERRED EMBODIMENTS

Figure 1:
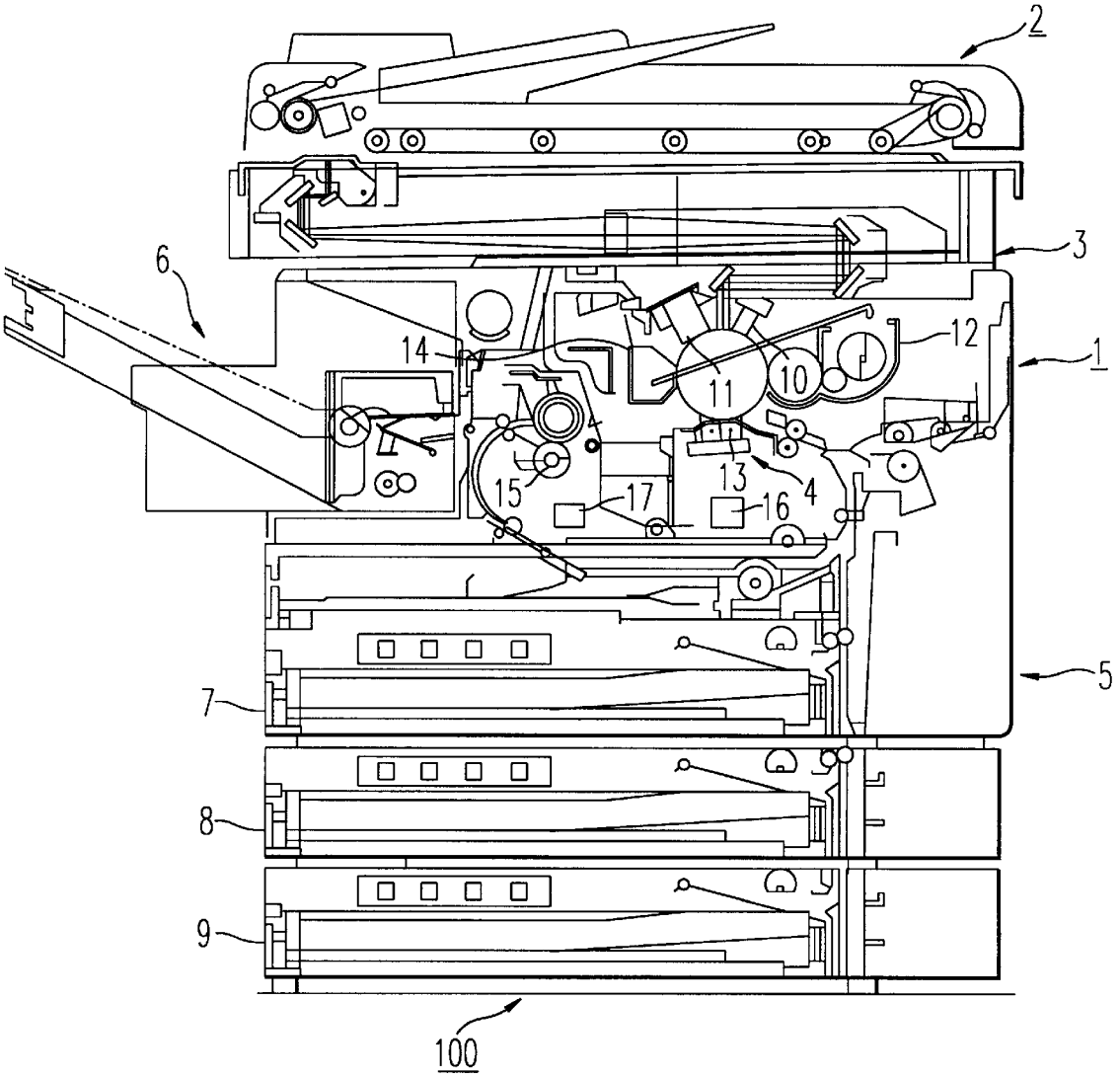
FIG. 1 is a sectional front elevation showing an overall view of a novel copying machine with front loading type paper cassettes as an exemplary embodiment of an image forming apparatus according to the present invention.

In describing preferred embodiments of the present invention illustrated in the drawings, specific terminology is employed for the sake of clarity. However, the present invention is not intended to be limited to the specific terminology so selected and it is to be understood that each specific element includes all technical equivalents which operate in a similar manner.

Referring now to the drawings, wherein like reference numerals designate identical or corresponding parts throughout the several views, and more particularly to FIG. 1 thereof, there is illustrated an overall view of a novel copying machine 100 as an exemplary embodiment of an image forming apparatus according to the present invention.

The novel copying machine 100 shown in FIG. 1 includes a base printing unit 1 and an automatic document feeding unit 2 mounted on a top surface of the base printing unit 1. The base printing unit 1 of the novel copying machine 100 is configured of several mechanical sections, such as, a document reading section 3, an image forming section 4, a front loading type paper feeding section 5 including three paper cassettes 7–9, a paper eject section 6, and so forth.

A prime constituent of the present invention among these constitutive elements is the image forming section 4 which is applied with a well-known electrophotography method using a single component type toner and which includes a photoconductive drum 10 for forming an image thereon, a charging unit 11 for charging a high voltage to the photoconductive drum 10, a development unit 12 for containing and supplying toner to the photoconductive drum 10, a transfer charging unit 13 for charging a high voltage to a recording material such as a sheet of paper, a cleaning unit 14 for cleaning toner remaining on the photoconductive drum 10, a fixing unit 15 for fixing an image formed with toner on the recording material, a high voltage power supply 16 for supplying high voltages to the photoconductive drum 10 and the development unit 12, a process timing controller 17 for controlling operational timings of an image forming process, and so forth.

Figure 2:
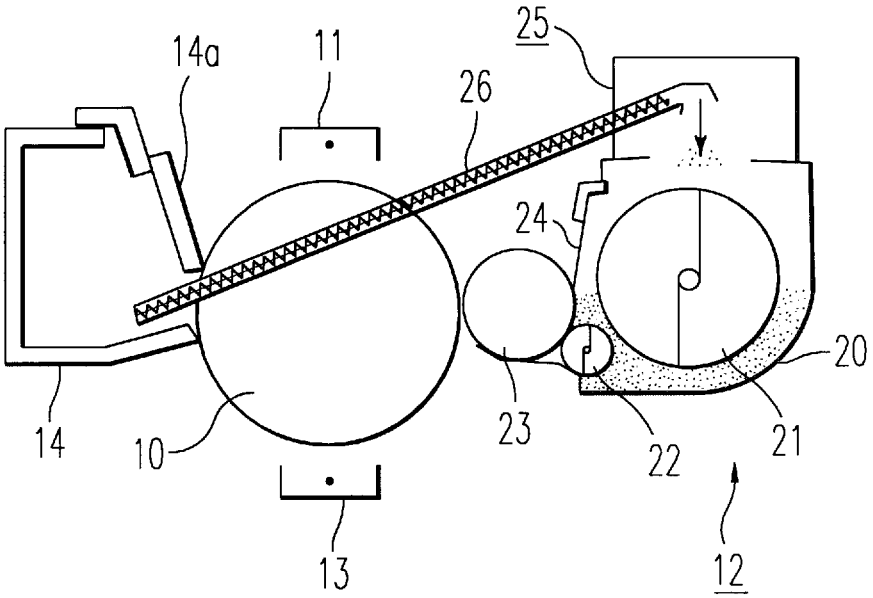
FIG. 2 is an enlarged view of a part, in which toner flows, of the novel copying machine shown in FIG. 1.

A mechanical configuration and an operational flow of the image forming section 4 is explained with reference to FIG. 2. The development unit 12 is formed with a toner tank 20 for storing the single component type toner. A toner agitation roller 21 for agitating the toner is mounted inside of the toner tank 20. A toner feeding roller 22 for feeding the toner out the toner tank 20 is also mounted inside of the toner tank 20. The toner fed out by the toner feeding roller 22 is attracted by a development roller 23 for carrying the toner, which adheres onto the surface thereof, and is carried thereby. The toner carried on the surface of the development roller 23 then passes a slit-like gap for the length of the development roller 23 made between the surface of the development roller 23 and an edge of a doctor blade 24 for regulating an amount of the toner sticking onto the surface of the development roller 23. At this time, an excessive amount of the toner on the surface of the development roller 23 is scraped off by the doctor blade 24.

The toner which has passed through the gap portion of the doctor blade 24 is then transferred onto an image formed on the surface of the photoconductive drum 10. The photoconductive drum 10 is mounted in a position in parallel to and in close proximity to the development roller 23. The photoconductive drum 10 is controlled to rotate clockwise while the development roller 23 rotates counterclockwise.

A predetermined charge is applied onto a surface of the rotating photoconductive drum 10 for the entire length thereof by the charging unit 11. Then, the rotating charged surface of the photoconductive drum 10 is exposed to a light source such as a laser beam, for example, which contains image information and moves in a transverse direction to the rotation of the photoconductive drum 10 so that an electrostatic latent image is formed on the surface of the photoconductive drum 10. Then, the latent image portion of the surface of the photoconductive drum 10 comes in contact with the development roller carrying the toner and, subsequently, the toner is attracted onto the latent image side so that the latent image is visualized by the toner.

The visualized toner is then transferred onto a recording paper supplied from the front loading type paper feeding section 5 by the transfer charging unit 13. The recording paper having an image formed thereon is further fed into the fixing unit 15 shown in FIG. 1 wherein the image is fixed onto the recording paper. Finally, the recording paper with the image is output through the paper eject section 6. Thus, a read image is transferred by means of an electric signal, recreated with toner, and formed on a recording paper. As another configuration of the image forming unit 12, an additional intermediate image carrying roller can be utilized. In such a case, the visualized image is transferred onto the additional intermediate image carrying roller before the toner image is transferred to the recording paper.

After the visualized image is transferred onto the recording paper, some amount of the toner remains unused on the surface of the photoconductive drum 10. Such unused=toner is referred to as secondary unused-toner as discussed hereinbefore, and is scraped off by a cleaning blade 14*a* mounted on the cleaning unit 14 as shown in FIG. 2.

The configuration of the image forming unit as set forth is well-known. However, the present invention implements a novel toner recycling system or a toner return system 25 including a toner return path 26 as shown in FIG. 2. One end of such a toner return system 25 is mounted on the cleaning unit 14, and the other end is mounted on the development unit 12, for returning the unused toner scraped off by the cleaning blade 14*a* to the development unit 12 in the direction indicated by the arrow shown in FIG. 2, so that the secondary unused-toner may not become a waste-product and can securely be used.

As is discussed hereinbefore, in the background copying machine adopting electrostaticphotography using a single component type toner, a toner-freshening operation at a predetermined interval to obviate the toner-filming phenomenon can not be achieved effectively or economically. The problem is that a large amount of toner may be consumed in a relatively short time in compensation for elimination of the toner-filming problem.

According to the present invention, when the copying machine 100 adopting electrostaticphotography using a single component type toner performs the toner-freshening operation at a predetermined interval, the secondary unused-toner scraped off the surface of the photoconductive drum 10 by the cleaning blade 14*a* is not regarded as a waste-product and instead is returned into the development unit 12 through the toner return system 25. In this way, the present invention obviates the problem of the background art in which a large amount of toner is consumed in a relatively short time in compensation for elimination of the toner-filming problem. In addition, the above-mentioned configuration may be applicable to a copying machine adopting electrostaticphotography using a dual-component type toner.

Next, a setting of a development bias is explained as an important condition of the image forming unit 12 under which the toner-freshening is effectively performed to obviate the toner-filming problem. In the copying machine 100 adopting electrostaticphotography using a single component type toner, a development roller may include an aluminum core and a roller-shaped dielectric bed adhered around the surface of the aluminum core. This aluminum core is applied with a predetermined electric bias to generate an electric field between the development roller 23 and the photoconductive drum 10 so that the toner on the surface of the development roller 23 can be transferred from the development roller 23 onto the photoconductive drum 10.

As is discussed hereinbefore, in a copying machine performing the toner-freshening operation at a predetermined interval, the toner stuck onto the non-image area of the surface of the development roller 23 passes through the doctor blade 24 for a number of times and generates an additional charge by friction and thus increases its charge. Accordingly, in such a non-image area, an attraction force or a Coulomb force made among toner particles increases and, consequently, the toner may not be transferred onto the photoconductive drum 10 side.

Furthermore, the toner in the toner-filming state on the surface of the development roller 23 is saturated with a development potential applied to the surface of the development roller 23 and, therefore, may not be transferred onto the photoconductive drum 10 side. In addition, despite the fact that the toner in the toner-filming state can not be removed by the toner-freshening operation at the ordinary setting of the development bias, the background copying machine is adopted with the ordinary setting of the development bias.

On the basis of the above-mentioned situation, a development bias during the toner-freshening operation is determined to satisfy a relationship such as $$|V_L - V_{bf}| > |V_L - V_b|.$$

in which $V_L$ is a potential at an electrostatic latent image formed on the photoconductive drum 10, $V_{bf}$ is a development bias during the toner-freshening operation, and $V_b$ is a development bias during an ordinary image forming operation. That is, an absolute value of the development bias during the toner-freshening operation is made greater than that during an ordinary image forming operation so as to help the primary unused-toner stuck on the development roller 23 easily transfer onto the electrostatic latent image formed on the photoconductive drum 10.

In this way, the toner-filming that can not be prohibited under an ordinary development bias can infallibly be prohibited so that the image forming unit 12 can be used for a long time span without the toner-filming problem arising and, therefore, the novel copying machine 100 becomes capable of performing copying in a superior quality for a long time span without the toner-filming problem arising.

More specifically, the above-mentioned development operation, wherein a photoconductive drum 10, for example, is used as a carrier for carrying a latent image thereon and such an image carrier is applied with a negative electric charge, can be achieved either by a so-called positive-to-positive development (PPD) method or by a so-called negative-to-positive development (NPD) method.

The following is an explanation of the PPD method. In the PPD method, the surface of the photoconductive drum 10 is evenly charged with a charge of approximately −800 volts, for example, by the charging unit 11. The surface of the photoconductive drum 10 is then exposed to a light source such as a laser beam, for example, which contains image information such as a letter, for example. As a result, the electric charge on the area of a letter image on the surface of the photoconductive drum 10, or a laser beam non-exposing area, is maintained at approximately −800volts while the electric charge on other areas out of the letter image, or a laser beam exposing area, is increased up to approximately −50 volts.

Under the above-mentioned electric charge distribution on the surface of the photoconductive drum 10, the toner on the development roller 23 is applied with a positive electric charge. However, this positive-charged toner from the development roller 23 will uncontrollably be attracted towards the −50 volts charged areas or the other areas out of the letter image as well as towards the −800 volts charged areas or the area of the letter image. Therefore, the development roller is applied with a charge of approximately −300 volts, for example, to control the electric field to direct from the −300 volts charged development roller 23 only to the −800 volts charged area of the letter image formed on the surface of the photoconductive drum 10 so that the positive-charged toner is attracted only towards the −800 volts charged area of the letter image of the surface of the photoconductive drum 10.

During the toner-freshening operation under the above-mentioned PPD method, an entire surface of the photoconductive drum 10 is not exposed to a light source such as a laser beam, for example. That is, the entire surface of the photoconductive drum 10 is handled as an area of a letter image and thus maintains a charge of approximately −800 volts thereon so that the positive-charged toner sticks on the entire surface of the development roller 23 and can securely be transferred onto the photoconductive drum 10 during the toner-freshening operation.

In addition, since an ordinary development bias of −300 volts is found insufficient to scrape the toner under the toner-filming phenomenon off the surface of the development roller 23, the embodiment of the present invention is applied with a development bias of −250 volts to be applied during the toner-freshening operation. Consequently, a potential gap between the development roller 23 and the photoconductive drum 10 becomes great enough to securely scrape off and to transfer the toner under the toner-filming phenomenon on the surface of the development roller 23 onto the photoconductive drum 10.

Next, the following is a detailed explanation of the NPD method. In the NPD method, the surface of the photoconductive drum 10 is evenly charged with a charge of approximately −800 volts, for example, by the charging unit 11. The surface of the photoconductive drum 10 is then exposed to a light source such as a laser beam, for example, which contains image information such as a letter, for example. As a result, the electric charge on the area of a letter image on the surface of the photoconductive drum 10, or a laser beam exposing area, is increased up to approximately −50 volts while the electric charge on other areas out of the letter image, or a laser beam non-exposing area, is maintained at approximately −800 volts.

Under the above-mentioned electric charge distribution on the surface of the photoconductive drum 10, the toner on the development roller 23 is applied with a negative electric charge. However, this negative-charged toner from the development roller 23 will not be attracted towards the −50 volts charged areas or the area of the letter image. Therefore, the development roller 23 is applied with a charge of approximately −600 volts, for example, to control the electric field to direct from the −50 volts charged area of the letter image formed on the surface of the photoconductive drum 10 to the −600 volts charged development roller 23 so that the negative-charged toner is attracted towards the −50 volts charged area of the letter image of the surface of the photoconductive drum 10.

During the toner-freshening operation under the above-mentioned PPD method, an entire surface of the photoconductive drum 10 is exposed to a light source such as a laser beam, for example. That is, the entire surface of the photoconductive drum 10 is handled as an area of a letter image and thus maintains a charge of approximately −800 volts thereon so that the negative-toner sticks on the entire surface of the development roller 23 and can securely be transferred onto the photoconductive drum 10 during the toner-freshening operation.

In addition, since an ordinary development bias of −600 volts is found insufficient to scrape the toner under the toner-filming phenomenon off the surface of the development roller 23, the embodiment of the present invention is provided with a development bias of −650 volts to be applied during the toner-freshening operation. Consequently, a potential gap between the development roller 23 and the photoconductive drum 10 becomes great enough to securely scrape off and to transfer the toner under the toner-filming phenomenon stuck on the surface of the development roller 23 onto the photoconductive drum 10.

Next, an explanation is made on an establishment of a preferable time period in which the toner-freshening operation can be timely and sufficiently performed. Since the toner under the toner-filming phenomenon is firmly stuck on the surface from the development roller 23, the toner-freshening operation during one rotation time period of the development roller 23 has been found by applicants to be insufficient to remove all the toner including the toner under the toner-filming phenomenon from the surface of the development roller 23. Therefore, a time period for performing the toner-freshening operation needs to be longer than one rotation time period of the development roller 23 so that all the toner, including the toner under the toner-filming phenomenon, from the surface of the development roller 23 can securely be scraped and transferred onto the photoconductive drum 10 during the toner-freshening operation.

Figure 3:
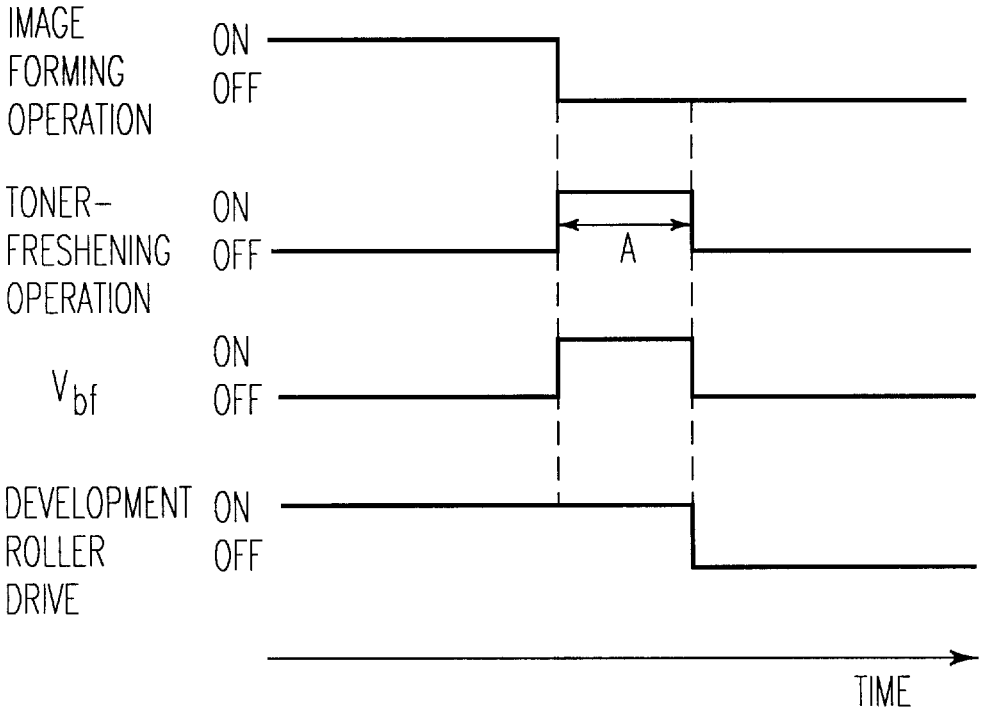
FIG. 3 is a time chart explaining a relationship between a time of a development bias $V_{bf}$ and a drive time of a development roller.

FIG. 3 is a time chart for showing an exemplary relationship between an image forming job and a toner-freshening operation which is continued for a time A indicated in FIG. 3 longer than one rotation time of the development roller 23 as mentioned hereinbefore. More specifically, when an image forming job is ended, the development roller 23 is continued to be driven and is applied with a development bias Vbf for three rotations of the development roller 23. The time A of the toner-freshening operation accordingly can include three rotations of the development roller 23. Thereby, the toner, including the toner under the toner-filming phenomenon, stuck on the surface of the development roller 23 can securely be transferred onto the photoconductive drum 10 during the toner-freshening operation. In addition, such a great amount of toner spent for the toner-freshening operation may not become a waste-product since the copying machine 100 according to the present invention is provided with the toner return system 25, as shown in FIG. 2, by which the toner used for the toner-freshening operation can be returned to the development unit 12.

By the thus arranged toner-freshening operation, the toner under the toner-filming phenomenon that can not be removed from the surface of the development roller 23 during the toner-freshening operation for one rotation time period of the development roller 23 can be securely removed from the surface of the development roller 23. Accordingly, it becomes possible that the image forming unit 12 included in the novel copying machine 100 can be used for a long time span without the toner-filming problem occurring and, therefore, the novel copying machine 100 becomes capable of performing copying in a superior quality for a long time span without the toner-filming problem occurring.

Figure 4:
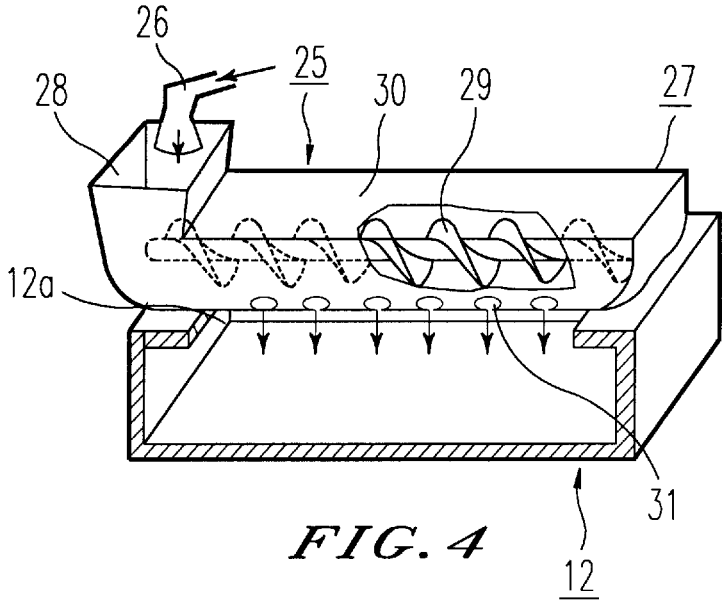
FIG. 4 is an illustration showing an example of a toner container and a toner return system including a toner agitating screw.

Next, a structure of the novel toner recycling system or the toner return system 25 is explained with reference to FIG. 4. In addition to the toner return path 26 shown in FIG. 2, this toner return system 25 shown in FIG. 4 includes a toner distributor 27 mounted on the top surface of the development unit 12 in which an opening 12*a* is formed. The toner distributor 27 includes an opening 28 for receiving the secondary unused-toner returned through the toner return path 26 as indicated by arrows in FIG. 4, a toner agitation screw 29, a case 30 in which the toner agitation screw 29 is rotatably held, and a number of holes 31 at a bottom of the case 30 through which the secondary unused-toner is distributed into the toner storing portion of the development unit 12 as indicated by arrows in FIG. 4.

The secondary unused-toner returned from the cleaning unit 14 tends to agglomerate because of a remaining electric charge thereon. If a relatively great amount of the agglomerated secondary unused-toner is directly returned into the development unit 12, a state of the electric charge of the toner stored in the storing portion of the development unit 12 may accordingly be affected and become unstable. As a result, in subsequent image forming operations, images may be made in a greatly inferior quality, for example, resulting in undesired dirty toner spots on the surface of the recording material, deterioration in image density, and so forth.

This particular problem of the secondary unused-toner can be solved by agitation, for example, before the secondary unused-toner is transferred into the development unit 12. More specifically, the secondary unused-toner returned through the opening 28 into the case 30 can be prohibited from agglomeration by being forcibly agitated by the rotational movement of the toner agitation screw 29 provided in the toner return system 25. At the same time, the secondary unused-toner is in turn transferred into a deep inside of the case 30 along the length of the development roller 23 by the rotational movement of the toner agitation screw 29 so as to be equally distributed along the length of the development roller 23. In this way, the potential problem that the secondary unused-toner makes the electric charge of the toner unstable in the development unit 12 can be prohibited.

Figure 5:
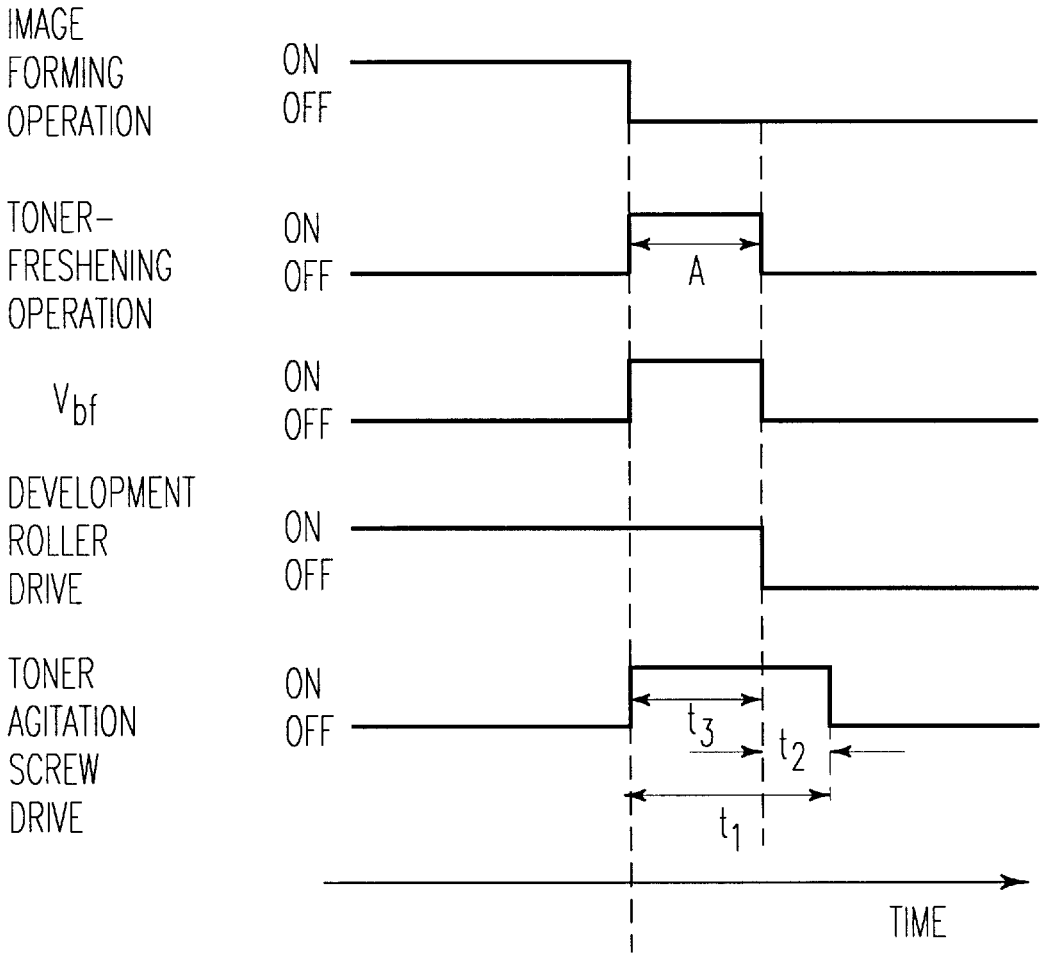
FIG. 5 is a time chart explaining relationships among a time of a development bias $V_{bf}$, a drive time of the development roller, and a drive time of the toner agitation screw.

Next, an establishment of a preferable time period in which the secondary unused-toner can be timely and sufficiently agitated by the toner agitation screw 29 is explained with reference to FIG. 5. As shown in FIG. 5, a drive of the toner agitation screw 29 is started at an end of an image forming job for a relatively sufficient time period of $t_1$, which is set longer than a time period of the toner-freshening operation, $t_3$, by a predetermined time of $t_2$. As an example, when the time period A of the toner-freshening operation is 3 seconds and the predetermined time of $t_2$, is 2 seconds, the time period of a drive of the toner agitation screw 29 is needed to be set as 5 seconds.

Next, an establishment of a preferable frequency of the toner-freshening operation is explained with reference to FIG. 6. Since the single component type toner is composed of low-melting toner, such toner used in the image forming unit 12 tends to cause the toner-filming problem by heat from friction with the doctor blade 24. In this case, the toner-freshening operation is needed to be performed at a relatively high frequency rate so as to sufficiently prohibit the toner-filming problem. As an example, the embodiment of the present invention is applied with a toner-freshening operation which can be performed at every non-image-transferring time during a continuous image forming operation.

More specifically, from the view point of recording paper transference, a continuous image forming operation includes an N times of an image transferring time period and an N-1 times of the non-image-transferring time. In the N times of the image transferring time period, a sheet of the recording paper is fed into the transfer charging unit 13 wherein an image is transferred onto the sheet of the recording paper. Contrary, in the N-1 times of the non-image-transferring time, no sheet of the recording paper is fed into the transfer charging unit 13 and the transfer charging unit 13 does not transfer an image. In accordance with these image-transferring and non-image-transferring times, there correspondingly presents an image-forming period in which the surface of the photoconductive drum 10 is used to form an image thereon and a non-image-forming period in which the surface of the photoconductive drum 10 iLs not used to form an image thereon.

Figure 6:
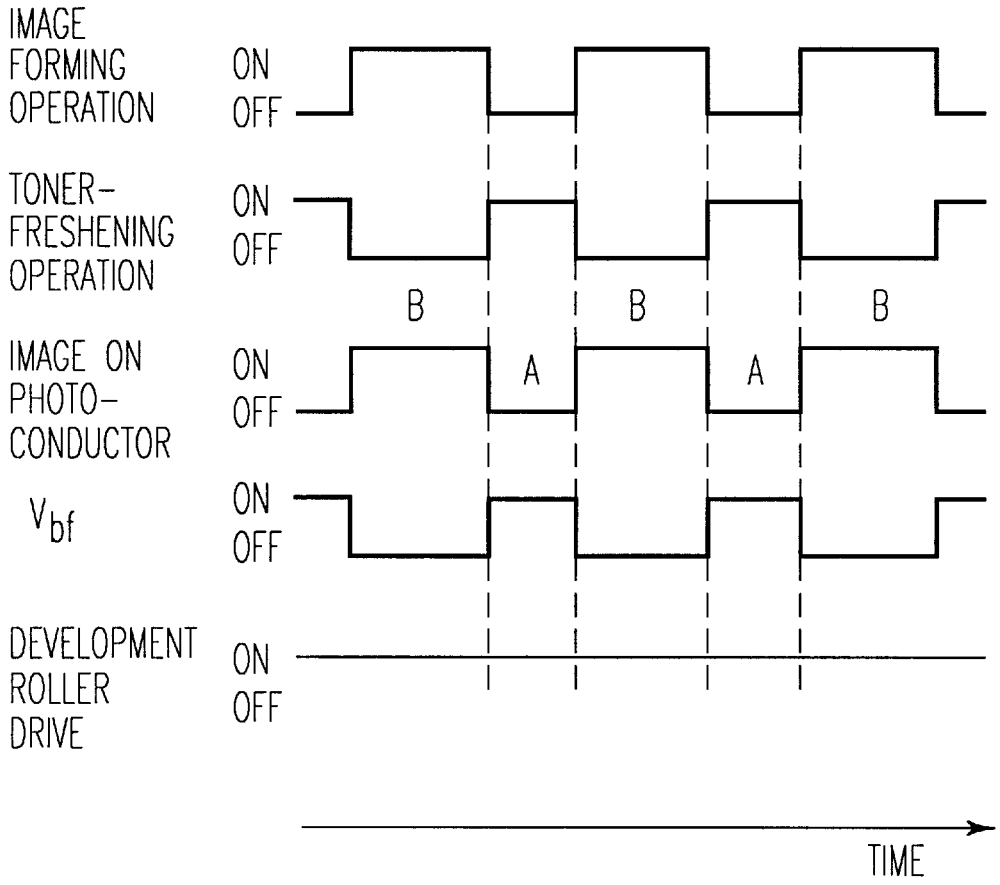
FIG. 6 is a time chart explaining relationships among a time of an image area and a non-image area on the photoconductive drum, a drive time of the development roller, and a time of a development bias $V_{bf}$.

As shown in FIG. 6, an N-1 times of a non-image-forming period A and an N times of an image-forming period B alternatively appear with respect to the surface of the photoconductive drum 10 in a continuous image forming operation. Accordingly, the development roller 23 is driven and applied with a development bias of $V_{bf}$ for the toner-freshening operation during every time when the surface of the photoconductive drum 10 is in the non-image-forming periods A, so that the toner-freshening operation can be performed at a relatively high frequency rate sufficient to prohibit the toner-filming problem. In addition, such a great amount of toner spent for the toner-freshening operation may not become a waste-product since the copying machine 100 according to the present invention is provided with the toner return system 25, as shown in FIG. 2, by which the toner used for the toner-freshening operation can be returned to the development unit 12.

Figure 7A:
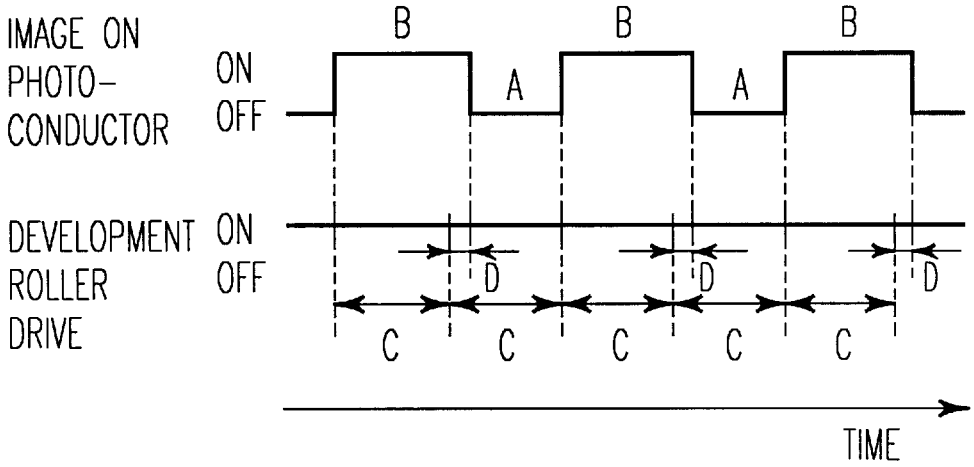
FIGS. 7(*a*) and 7(*b*) are time charts each showing a relationship between times of the image area and the non-image area on the photoconductive drum and a drive time of the development roller.
Figure 7B:
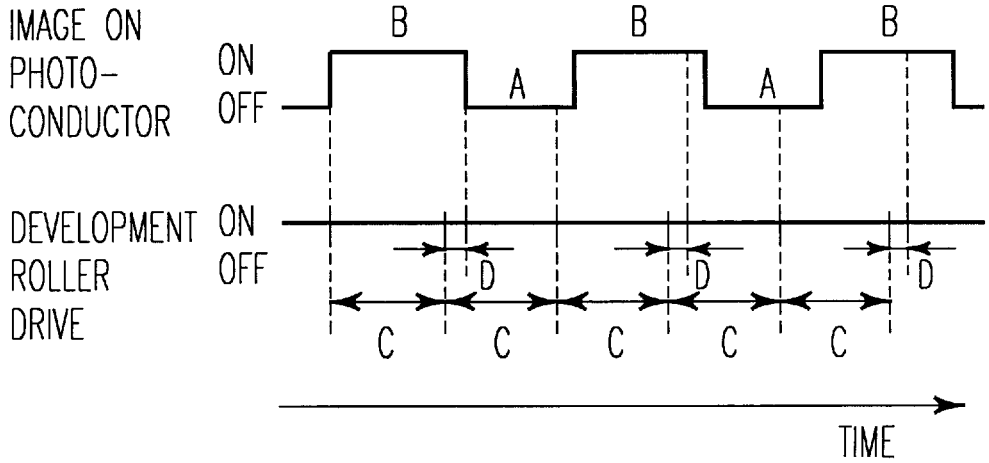

FIG. 7(*a*) indicates a possibility of the toner-filming phenomenon in a synchronized rotational movement between the photoconductive drum 10 and the development roller 23. As is previously discussed, FIG. 7(*a*) also presents an N-1 times of a non-image-forming period A and an N times of an image-forming period B alternatively with respect to the surface of the photoconductive drum 10 in a continuous image forming operation. When the development roller 23 moves for one rotation in a time C making in synchronism with the photoconductive drum 10, a time D may arise in which a region in the surface of the development roller 23 is never subjected to the toner-freshening operation. In such a case, the toner-filming problem may occur on such a region in the surface of the development roller 23. This problem can be solved by disturbing the synchronization between the photoconductive drum 10 and the development roller 23, as shown in FIG. 7(*b*), by changing, as examples, a diameter of the development roller 23, a time period of the non-image-transferring, a rotation speed ratio of the development roller 23 relative to the photoconductive drum 10.

In order to prohibit the toner-filming phenomenon in a more complete and secure manner, a time period of the toner-freshening operation during the non-image-forming or the non-image-transferring period may be determined to be longer than one rotation period of the development roller 23, as shown in FIG. 7(*b*). More specifically, the novel copying machine 100 according to the present invention is provided with the non-image-transferring or the non-image-forming period which is arranged to be continued for a time period of three rotations, for example, of the development roller 23 so that one cycle of the toner-freshening operation can be performed for three rotations, for example, of the development roller 23 during this non-image transferring or non-image-forming period. In addition, such a great amount of toner spent for the toner-freshening operation may not become a waste-product since the copying machine 100 according to the present invention is provided with the toner return system 25, as shown in FIG. 2, by which the toner used for the toner-freshening operation can be returned to the development unit 12.

Next, dust protection is explained. When the toner is recycled with an exemplary structure as shown in FIG. 2, the development unit 12 must be kept away from dust, e.g. paper dust or the like. The novel copying machine 100 according to the present invention is provided with a front loading type paper feeding section 5 including three paper cassettes 7–9, as an example. With these front loading type paper cassettes 7–9, there are less openings connecting an inside of the machine to the external environment, and the recording paper is hidden inside of the machine, so that dust, e.g. paper dust or the like, will rarely come inside of the machine and the recording paper is kept clean without dust deposited thereon.

Further, the novel copying machine 100 according to the present invention may be provided with a paper feeding mechanism with which a sheet of the recording paper is reversed before entering into the transfer charging unit 13 so that an image is transferred onto the bottom side of the recording paper which is kept clean without dust deposited thereon.

Figure 8A:
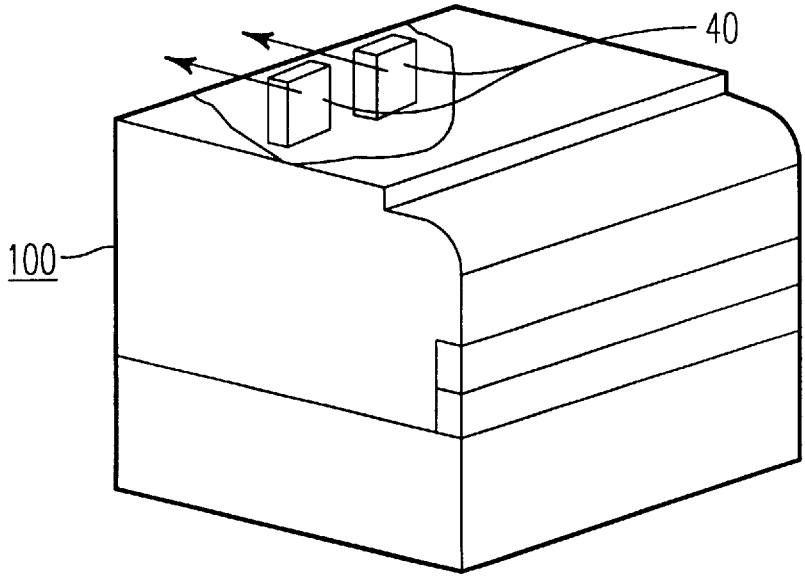
FIG. 8(*a*) is a partly sectional, perspective, and schematic illustration of the novel copying machine as a modified embodiment according to the present invention.
Figure 8B:
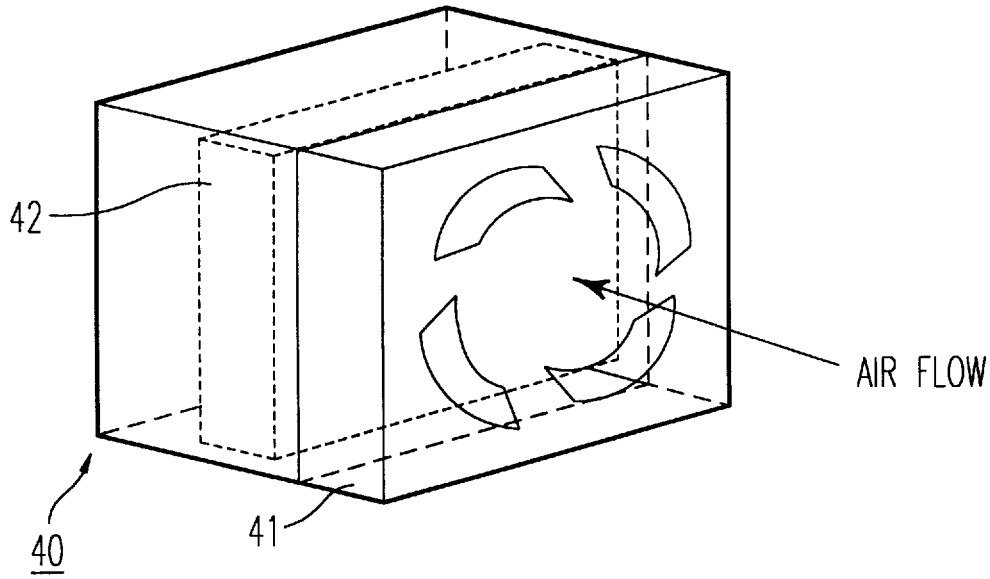

Furthermore, dust already inside of the copying machine 100 is securely ejected with dust and heat ejection fans 40 as shown in FIGS. 8(*a*) and 8(*b*). Each dust and heat ejection fan 40 includes 41 electrostatic filter 42 therein which is made of fine plastic fiber such as a polyethylene and holds an electrostatic charge when a wind passes through so that the dust or the like inside of the machine is attracted to the filter 42.

With a combination used of these dust protections as described above, the toner return system 25 can be protected from dust, e.g. paper dust or the like, so that the novel copying machine 100 according to the present invention becomes capable of performing copying in a superior quality for a long time span without disturbance by dust, e.g. paper dust or the like.

Obviously, numerous additional modifications and variations of the present invention are possible in light of the above teachings. It is therefore to be understood that within the scope of the appended claims, the present invention may be practiced otherwise than as specifically described herein.

What is claimed as new and is desired to be secured by: Letters Patent of the United States is:

1. An image forming apparatus with a toner freshening and returning operation in which toner is formed over an area of a toner carrying surface of a toner carrying means for carrying toner and then, without transferring said toner onto a recording material, said toner is returned to be used in an ordinary image forming operation, comprising:

toner containing means for containing toner;

image carrying means for carrying an electrostatic latent image thereon;

image writing means for writing said electrostatic latent image in at least one of said ordinary image forming operation and said toner freshening and returning operation;

high voltage power applying means for applying a high voltage power to said toner carrying means to generate a voltage gap between said toner carrying means and said image carrying means to transfer toner from said toner carrying means to said image carrying means;

toner collecting means for collecting said toner deposited on said image carrying means;

toner returning means for returning said toner collected by said toner collecting means to said toner containing means; and toner freshening and returning control means for performing said freshening and returning operation at a predetermined timing for a predetermined time period.

2. The image forming apparatus according to claim 1, wherein said toner freshening and returning control means controls said high voltage power applying means to apply a first high voltage power to said toner carrying means for said ordinary image forming operation and to apply a second high voltage power to said toner carrying means for said toner freshening and returning operation, and said toner freshening and returning control means switches said high power voltage applying means between applying said first high power voltage and said second high power voltage.

3. The image forming apparatus according to claim 2, wherein said toner freshening and returning control means controls to make a size of an area over which the toner is formed in said toner freshening and returning operation greater than a size of the area of the toner carrying surface of said toner carrying means during a time of performing said toner freshening and returning operation.

4. The image forming apparatus according to claim 3, further comprising:

toner mixing means for receiving, for temporarily storing, and for mixing said toner returned through said toner returning means before returning said toner into said toner containing means.

5. The image forming apparatus according to claim 4, wherein said toner freshening and returning control means controls said toner mixing means to start to mix said toner at a same time when said high voltage power applying means starts to apply said second high voltage power to said toner carrying means and to continue to mix said toner for a predetermined time period after said high voltage power applying means finishes applying said second high power voltage power to said toner carrying means.

6. The image forming apparatus according to claim 5, wherein said toner freshening and returning control means controls to perform said toner freshening and returning operation during a time period of an event when an image carrying region of said image carrying means carries no image and said image carrying region passes through said toner carrying means during a continuous operation of said ordinary image forming operation.

7. The image forming apparatus according to claim 6, wherein said toner freshening and returning control means controls to lengthen said time period of the event when the image carrying region of said image carrying means carries no image and said image carrying region passes through said toner carrying means during a continuous operation of said ordinary image forming operation, to an extent relatively longer than a time necessary for said toner carrying means to carry said toner by a single time, so as to make a size of an area over which toner is formed in said toner freshening and returning operation greater than a size of the area of the toner carrying surface of said toner carrying means; during the time of performing said toner freshening and returning operation.

8. The image forming apparatus according to claim 7, wherein said toner freshening and returning control means controls to perform said toner freshening and returning operation out of synchronism with a movement of said toner carrying means.

9. The image forming apparatus according to claim 6, wherein said toner freshening and returning control means controls to Perform said toner freshening and returning operation out of synchronism with a movement of said toner carrying means.

10. The image forming apparatus according to claim 4, wherein said toner freshening and returning control means controls to perform said toner freshening and returning operation during a time period of an event when an image carrying region of said image carrying means carries no image and said image carrying region passes through said toner carrying means during a continuous operation of said ordinary image forming operation.

11. The image forming apparatus according to claim 10, wherein said toner freshening and returning control means controls to lengthen said time period of the event when the image carrying region of said image carrying means carries no image and said image carrying region passes through said toner carrying means during a continuous operation of said ordinary image forming operation, to an extent relatively longer than a time necessary for said toner carrying means to carry said toner by a single time, so as to make a size of an area over which toner is formed in said toner freshening and returning operation greater than a size of the area of the toner carrying surface of said toner carrying means during a time of performing said toner freshening and returning operation.

12. The image forming apparatus according to claim 11, wherein said toner freshening and returning control means controls to perform said toner freshening and returning operation out of synchronism with a movement of said toner carrying means.

13. The image forming apparatus according to claim 10, wherein said toner freshening and returning control means controls to perform said toner freshening and returning operation out of synchronism with a movement of said toner carrying means.

14. The image forming apparatus according to claim 3, wherein said toner freshening and returning control means controls to Perform said toner freshening and returning operation during a time period of an event when an image carrying region of said image carrying means carries no image and said image carrying region passes through said toner carrying means during a continuous operation of said ordinary image forming operation.

15. The image forming apparatus according to claim 14, wherein said toner freshening and returning control means controls to lengthen said time period of the event when the image carrying region of said image carrying means carries no image and said image carrying region passes through said toner carrying means during continuous operation of said ordinary image forming operation, to an extent relatively longer than a time necessary for said toner carrying means to carry said toner by a single time, so as to make a size of an area over which toner is formed in said toner freshening and returning operation greater than a size of the area of the toner carrying surface of toner carrying means during a time of performing said toner freshening and returning operation.

16. The image forming apparatus according to claim 15, wherein said toner freshening and returning control means controls to Perform said toner freshening and returning operation out of synchronism with a movement of said toner carrying means.

17. The image forming apparatus according to claim 14, wherein said toner freshening and returning control means controls to perform said toner freshening and returning operation out of synchronism with a movement of said toner carrying means.

18. The image forming apparatus according to claim 2, further comprising:

toner mixing means for receiving, for temporarily storing, and for mixing said toner returned through said toner returning means before returning said toner into said toner containing means.

19. The image forming apparatus according to claim 18, wherein said toner freshening and returning control means controls said toner mixing means to start to mix said toner at a same time when said high voltage power applying means starts to apply said second high voltage power to said toner carrying means and to continue to mix said toner for a predetermined time period after said high voltage power applying means finishes applying said second high power voltage power to said toner carrying means.

20. The image forming apparatus according to claim 19, wherein said toner freshening and returning control means controls to perform said toner freshening and returning operation during a time period of an event when an image carrying region of said image carrying means carries no image and said image carrying region passes through said toner carrying means during a continuous operation of said ordinary image forming operation.

21. The image forming apparatus according to claim 20, wherein said toner freshening and returning control means controls to lengthen said time period of the event when the image carrying region of said image carrying means carries no image and said image carrying region passes through said toner carrying means during a continuous operation of said ordinary image forming operation, to an extent relatively longer than a time necessary for said toner carrying means to carry said toner by a single time, so as to make a size of an area over which toner is formed in said toner freshening and returning operation greater than a size of the area of the toner carrying surface of said toner carrying means during the time of performing said toner freshening and returning operation.

22. The image forming apparatus according to claim 21, wherein said toner freshening and returning control means controls to perform said toner freshening and returning operation out of synchronism with a movement of said toner carrying means.

23. The image forming apparatus according to claim 20, wherein said toner freshening and returning control means controls to perform said toner freshening and returning operation out of synchronism with a movement of said toner carrying means.

24. The image forming apparatus according to claim 18, wherein said toner freshening and returning control means controls to perform said toner freshening and returning operation during a time period of an event when an image carrying region of said image carrying means carries no image and said image carrying region passes through said toner carrying means during a continuous operation of said ordinary image forming operation.

25. The image forming apparatus according to claim 24, wherein said toner freshening and returning control means controls to lengthen said time period of the event when the image carrying region of said image carrying means carries no image and said image carrying region passes through said toner carrying means during continuous operation of said ordinary image forming operation, to an extent relatively longer than a time necessary for said toner carrying means to carry said toner by a single time, so as to make a size of an area over which toner is formed in said toner freshening and returning operation greater than a size of the area of the toner carrying surface of said toner carrying means during a time of performing said toner freshening and returning operation.

26. The image forming apparatus according to claim 25, wherein said toner freshening and returning control means controls to perform said toner freshening and returning operation out of synchronism with a movement of said toner carrying means.

27. The image forming apparatus according to claim 24, wherein said toner freshening and returning control means controls to perform said toner freshening and returning operation out of synchronism with a movement of said toner carrying means.

28. The image forming apparatus according to claim 2, wherein said toner freshening and returning control means controls to perform said toner freshening and returning operation during a time period of an event when an image carrying region of said image carrying means carries no image and said image carrying region passes through said toner carrying means during a continuous operation of said ordinary image forming operation.

29. The image forming apparatus according to claim 28, wherein said toner freshening and returning control means controls to lengthen said time period of the event when the image carrying region of said image carrying means carries no image and said image carrying region passes through said toner carrying means during continuous operation of said ordinary image forming operation, to an extent relatively longer than a time necessary for said toner carrying means to carry said toner by a single time, so as to make a size of an area over which toner is formed in said toner freshening and returning operation greater than a size of the area of the toner carrying surface of said toner carrying means during a time of performing said toner freshening and returning operation.

30. The image forming apparatus according to claim 29, wherein said toner freshening and returning control means controls to perform said toner freshening and returning operation out of synchronism with a movement of said toner carrying means.

31. The image forming apparatus according to claim 28, wherein said toner freshening and returning control means controls to perform said toner freshening and returning operation out of synchronism with a movement of said toner carrying means.

32. The image forming apparatus according to claim 1, wherein said toner freshening and returning control means controls to make a size of an area over which the toner is formed in said toner freshening and returning operation greater than a size of the area of the toner carrying surface of said toner carrying means during a time of performing said toner freshening and returning operation.

33. The image forming apparatus according to claim 32, further comprising:

toner mixing means for receiving, for temporarily storing, and for mixing said toner returned through said toner returning means before returning said toner into said toner containing means.

34. The image forming apparatus according to claim 33, wherein said toner freshening and returning control means controls said toner mixing means to start to mix said toner at a same time when said high voltage power applying means starts to apply said second high voltage power to said toner carrying means and to continue to mix said toner for a predetermined time period after said high voltage power applying means finishes applying said second high power voltage power to said toner carrying means.

35. The image forming apparatus according to claim 34, wherein said toner freshening and returning control means controls to perform said toner freshening and returning operation during a time period of an event when an image carrying region of said image carrying means carries no image and said image carrying region passes through said toner carrying means during a continuous operation of said ordinary image forming operation.

36. The image forming apparatus according to claim 35, wherein said toner freshening and returning control means controls to lengthen said time period of the event when the image carrying region of said image carrying means carries no image and said image carrying region passes through said toner carrying means during a continuous operation of said ordinary image forming operation, to an extent relatively longer than a time necessary for said toner carrying means to carry said toner by a single time, so as to make a size of an area over which toner is formed in said toner freshening and returning operation greater than a size of the area of the toner carrying surface of said toner carrying means during a time of performing said toner freshening and returning operation.

37. The image forming apparatus according to claim 36, wherein said toner freshening and returning control means controls to perform said toner freshening and returning operation out of synchronism with a movement of said toner carrying means, so that an entire toner carrying surface of said toner carrying means can be subjected to said toner freshening and returning operation.

38. The image forming apparatus according to claim 35, wherein said toner freshening and returning control means controls to perform said toner freshening and returning operation out of synchronism with a movement of said toner carrying means.

39. The image forming apparatus according to claim 33, wherein said toner freshening and returning control means controls to perform said toner freshening and returning operation during a time period of an event when an image carrying region of said image carrying means carries no image and said image carrying region passes through said toner carrying means during a continuous operation of said ordinary image forming operation.

40. The image forming apparatus according to claim 39, wherein said toner freshening and returning control means controls to lengthen said time period of the event when the image carrying region of said image carrying means carries no image and said image carrying region passes through said toner carrying means during a continuous operation of said ordinary image forming operation, to an extent relatively longer than a time necessary for said toner carrying means to carry said toner by a single time, so as to make a size of an area over which toner is formed in said toner freshening and returning operation greater than a size of the area of the toner carrying surface of said toner carrying means during a time of performing said toner freshening and returning operation.

41. The image forming apparatus according to claim 40, wherein said toner freshening and returning control means controls to perform said toner freshening and returning operation out of synchronism with a movement of said toner carrying means.

42. The image forming apparatus according to claim 39, wherein said toner freshening and returning control means controls to perform said toner freshening and returning operation out of synchronism with a movement of said toner carrying means.

43. The image forming apparatus according to claim 32, wherein said toner freshening and returning control means controls to perform said toner freshening and returning operation during a time period of an event when an image carrying region of said image carrying means carries no image and said image carrying region passes through said toner carrying means during a continuous operation of said ordinary image forming operation.

44. The image forming apparatus according to claim 43, wherein said toner freshening and returning control means controls to lengthen said time period of the event when the image carrying region of said image carrying means carries no image and said image carrying region passes through said toner carrying means during continuous operation of said ordinary image forming operation, to an extent relatively longer than a time necessary for said toner carrying means to carry said toner by a single time, so as to make a size of an area over which toner is formed in said toner freshening and returning operation greater than a size of the area of the toner carrying surface of said toner carrying means during a time of performing said toner freshening and returning operation.

45. The image forming apparatus according to claim 44, wherein said toner freshening and returning control means controls to perform said toner freshening and returning operation out of synchronism with a movement of said toner carrying means.

46. The image forming apparatus according to claim 43, wherein said toner freshening and returning control means controls to perform said toner freshening and returning operation out of synchronism with a movement of said toner carrying means.

47. The image forming apparatus according to claim 1, further comprising:

toner mixing means for receiving, for temporarily storing, and for mixing said toner returned through said toner returning means before returning said toner into said toner containing means.

48. The image forming apparatus according to claim 47, wherein said toner freshening and returning control means controls said toner mixing means to start to mix said toner at a same time when said high voltage power applying means starts to apply said second high voltage power to said toner carrying means and to continue to mix said toner for a predetermined time period after said high voltage power applying means finishes applying said second high power voltage power to said toner carrying means.

49. The image forming apparatus according to claim 48, wherein said toner freshening and returning control means controls to perform said toner freshening and returning operation during a time period of an event when an image carrying region of said image carrying means carries no image and said image carrying region passes through said toner carrying means during a continuous operation of said ordinary image forming operation.

50. The image forming apparatus according to claim 49, wherein said toner freshening and returning control means controls to lengthen said time period of the event when the image carrying region of said image carrying means carries no image and said image carrying region passes through said toner carrying means during a continuous operation of said ordinary image forming operation, to an extent relatively longer than a time necessary for said toner carrying means to carry said toner by a single time, so as to make a size of an area over which toner is formed in said toner freshening and returning operation greater than a size of the area of the toner carrying surface of said toner carrying means during a time of performing said toner freshening and returning operation.

51. The image forming apparatus according to claim 50, wherein said toner freshening and returning control means controls to perform said toner freshening and returning operation out of synchronism with a movement of said toner carrying means.

52. The image forming apparatus according to claim 49, wherein said toner freshening and returning control means controls to perform said toner freshening and returning operation out of synchronism with a movement of said toner carrying means.

53. The image forming apparatus according to claim 47, wherein said toner freshening and returning control means controls to perform said toner freshening and returning operation during a time period of an event when an image carrying region of said image carrying means carries no image and said image carrying region passes through said toner carrying means during a continuous operation of said ordinary image forming operation.

54. The image forming apparatus according to claim 53, wherein said toner freshening and returning control means controls to lengthen said time period of the event when the image carrying region of said image carrying means carries no image and said image carrying region passes through said toner carrying means during continuous operation of said ordinary image forming operation, to an extent relatively longer than a time necessary for said toner carrying means to carry said toner by a single time, so as to make a size of an area over which toner is formed in said toner freshening and returning operation greater than a size of the area of the toner carrying surface of said toner carrying means during a time of performing said toner freshening and returning operation.

55. The image forming apparatus according to claim 54, wherein said toner freshening and returning control means controls to perform said toner freshening and returning operation out of synchronism with a movement of said toner carrying means.

56. The image forming apparatus according to claim 53, wherein said toner freshening and returning control means controls to perform said toner freshening and returning operation out of synchronism with a movement of said toner carrying means.

57. The image forming apparatus according to claim 1, wherein said toner freshening and returning control means controls to perform said toner freshening and returning operation during a time period of an event when an image carrying region of said image carrying means carries no image and said image carrying region passes through said toner carrying means during a continuous operation of said ordinary image forming operation.

58. The image forming apparatus according to claim 57, wherein said toner freshening and returning control means controls to lengthen said time period of the event when the image carrying region of said image carrying means carries no image and said image carrying region passes through said toner carrying means during continuous operation of said ordinary image forming operation, to an extent relatively longer than a time necessary for said toner carrying means to carry said toner by a single time, so as to make a size of an area over which toner is formed in said toner freshening and returning operation greater than a size of the area of the toner carrying surface of said toner carrying means during a time of performing said toner freshening and returning operation.

59. The image forming apparatus according to claim 58, wherein said toner freshening and returning control means controls to perform said toner freshening and returning operation out of synchronism with a movement of said toner carrying means.

60. The image forming apparatus according to claim 57, wherein said toner freshening and returning control means controls to perform said toner freshening and returning operation out of synchronism with a movement of said toner carrying means,.

61. The image forming apparatus according to claim 1, wherein said recording material is stored in a recording material cassette by which said recording material is kept away from dust so as to effectively perform said toner freshening and returning operation.

62. The image forming apparatus according to claim 61, wherein said image forming apparatus includes a heat air ejecting fan which includes an electrostatic filter for collecting dust so as to effectively perform said toner freshening and returning operation.

63. The image forming apparatus according to claim 1, wherein said image forming apparatus includes a heat air ejecting fan which includes an electrostatic filter for collecting dust so as to effectively perform said toner freshening and returning operation.

64. An image forming apparatus with a toner freshening and returning operation in which toner is formed over an area of a toner carrying surface of a toner carrying roller for carrying toner and then, without transferring said toner onto a recording material, said toner is returned to be used in an ordinary image forming operation, comprising:

a toner container for containing toner;

an image carrying drum for carrying an electrostatic latent image thereon;

an image writing unit for writing said electrostatic latent image in at least one of said ordinary image forming operation and said toner freshening and returning operation;

a high voltage power unit for applying a high voltage power to said toner carrying roller to generate a voltage gap between said toner carrying roller and said image carrying drum to transfer toner from said toner carrying roller to said image carrying drum;

a toner collecting unit for collecting said toner deposited on said image carrying drum;

a toner returning unit for returning said toner collected by said toner collecting unit to said toner container; and a toner freshening and returning controller for performing said freshening and returning operation at a predetermined timing for a predetermined time period.

65. The image forming apparatus according to claim 64, wherein said toner freshening and returning controller controls said high voltage power unit to apply a first high voltage power to said toner carrying roller for said ordinary image forming operation and to apply a second high voltage power to said toner carrying roller for said toner freshening and returning operation, and said toner freshening and returning controller switches said first high voltage power unit between applying said first high voltage power and said second high voltage power.

66. The image forming apparatus according to claim 64, wherein said toner freshening and returning controller controls to make a size of an area over which the toner is formed in said toner freshening and returning operation greater than a size of the area of the toner carrying surface of said toner carrying roller during a time of performing said toner freshening and returning operation.

67. The image forming apparatus according to claim 64, further comprising:

a toner mixer for receiving, for temporarily storing, and for mixing said toner returned through said toner returning uni before returning said toner into said toner container.

68. The image forming apparatus according to claim 67, wherein said toner freshening and returning controller controls said toner mixer to start to mix said toner at a same time when said high voltage power unit starts to apply said second high voltage power to said toner carrying roller and to continue to mix said toner for a predetermined time period after said high voltage power unit finishes applying said second high voltage power to said toner carrying roller.

69. The image forming apparatus according to claim 64, wherein said toner freshening and returning controller controls to perform said toner freshening and returning operation during a time period of an event when an image carrying region of said image carrying drum carries no image and said image carrying region passes through said toner carrying roller during a continuous operation of said ordinary image forming operation.

70. The image forming apparatus according to claim 69, wherein said toner freshening and returning controller controls to lengthen said time period of the event when the image carrying region of said image carrying roller carries no image and said image carrying region passes through said toner carrying roller during continuous operation of said ordinary image forming operation, to an extent relatively longer than a time necessary for said toner carrying roller to carry said toner by a single time, so as to make a size of an area over which toner is formed in said toner freshening and returning operation greater than a size of the area of the toner carrying surface of said toner carrying roller during a time of performing said toner freshening and returning operation.

71. The image forming apparatus according to claim 69, wherein said toner freshening and returning controller controls to perform said toner freshening and returning operation out of synchronism with a movement of said toner carrying roller.

72. The roller forming apparatus according to claim 64, further comprising a recording material cassette for storing said recording material by which said recording material is kept away from dust so as to effectively perform said toner freshening and returning operation.

73. The image forming apparatus according to claim 64, further comprising a heat air ejecting fan including an electrostatic filter for collecting dust so as to effectively perform said toner freshening and returning operation.

* * * * *